US010309738B1

(12) United States Patent
Vesich et al.

(10) Patent No.: US 10,309,738 B1
(45) Date of Patent: Jun. 4, 2019

(54) FIREARM MOUNTABLE AMMUNITION CASE CATCHER

(71) Applicant: Battenfeld Technologies, Inc., Columbia, MO (US)

(72) Inventors: Anthony Vesich, Columbia, MO (US); James Tayon, Moberly, MO (US); Michael Cottrell, Columbia, MO (US); Dennis W. Cauley, Jr., Booneville, MO (US); Timothy Kinney, Warrenton, MO (US); Mark Dalton, Columbia, MO (US); Justin Burke, Columbia, MO (US); Brian Steere, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 15/852,902

(22) Filed: Dec. 22, 2017

(51) Int. Cl.
*F41A 9/60* (2006.01)

(52) U.S. Cl.
CPC ..... *F41A 9/60* (2013.01)

(58) Field of Classification Search
CPC ..... F41A 9/60
USPC ..... 42/98; 89/33.4
See application file for complete search history.

(56) References Cited

U.S. PATENT DOCUMENTS 1,201,189 A * 10/1916 Johnson ..... F41A 9/60 224/0.5
2,384,678 A * 9/1945 Holton ..... F41A 9/57 193/2 R
3,153,981 A * 10/1964 Brass ..... F41A 9/60 42/98
3,771,248 A * 11/1973 Linehan ..... F41A 9/60 42/106
4,028,834 A * 6/1977 Dobson ..... F41A 9/60 42/98
4,110,927 A * 9/1978 Morris ..... F41A 9/60 42/98
4,594,803 A * 6/1986 Muncy ..... F41A 9/60 42/98
4,715,141 A * 12/1987 Kohnke ..... F41A 9/60 42/98
4,903,426 A * 2/1990 Bammate ..... F41A 9/60 42/98

(Continued)

OTHER PUBLICATIONS

Battenfeld Technologies, Inc., Caldwell AR PIC Rail Brass Catcher, Jan. 1, 2016, 2 pages.

(Continued)

*Primary Examiner* — Joshua E Freeman
(74) *Attorney, Agent, or Firm* — Stinson Leonard Street LLP

(57) ABSTRACT

A cartridge case catcher and associated methods. The cartridge case catcher is configured to catch cartridges ejected from an action of a firearm. The cartridge case catcher includes a mount for mounting to the firearm. The cartridge case catcher includes a receptacle having a case compartment sized for carrying cases ejected from the action. A mouth of the catcher provides access to the case compartment. A pivot connection connects the receptacle to the mount. The receptacle is movable with respect to the mount about the pivot connection between an operational orientation to receive cases ejected from the firearm action and an access orientation in which the receptacle permits access to the action of the firearm.

16 Claims, 11 Drawing Sheets

(56) References Cited

U.S. PATENT DOCUMENTS 5,138,787 A * 8/1992 Riddle ..... F41A 9/60 42/98
5,285,593 A * 2/1994 Bammate ..... F41A 9/60 42/98
5,398,439 A * 3/1995 Harless ..... F41A 9/60 42/98
6,173,520 B1 * 1/2001 Bucciarelli ..... F41A 9/60 42/98
6,347,475 B1 * 2/2002 Trostel ..... F41A 9/60 42/98
6,530,169 B1 * 3/2003 Griffin ..... F41A 9/60 42/98
7,168,200 B2 * 1/2007 Perez ..... F41A 9/60 42/98
7,536,821 B1 * 5/2009 Saur ..... F41A 9/60 181/252
7,941,961 B1 * 5/2011 Cooper ..... F41G 11/003 42/98
8,707,521 B1 * 4/2014 Mack ..... E05D 11/06 16/326
8,732,906 B1 * 5/2014 Van Gennep ..... E05D 11/1007 16/229
9,945,626 B2 * 4/2018 Rosenthal ..... F41A 9/60
2002/0007581 A1 * 1/2002 Bucciarelli ..... F41G 1/35 42/98
2006/0101699 A1 * 5/2006 Perez ..... F41A 9/60 42/98
2011/0094058 A1 * 4/2011 Van Gennep ..... E05D 11/1007 16/327
2012/0023803 A1 * 2/2012 Taylor ..... F41A 9/60 42/90
2015/0316338 A1 * 11/2015 Rosenthal ..... F41A 9/60 42/98
2016/0178314 A1 * 6/2016 Kielsmeier ..... F41C 23/14 42/73
2017/0097201 A1 * 4/2017 Rosenthal ..... F41A 9/60

OTHER PUBLICATIONS

Battenfeld Technologies, Inc., Caldwell AR-15 Brass Catcher, Jan. 1, 2016, 2 pages.

* cited by examiner

FIREARM MOUNTABLE AMMUNITION CASE CATCHER

FIELD

The present disclosure generally relates to firearm accessories, and more particularly to a firearm mounted catcher for catching spent ammunition cases ejected from the firearm.

BACKGROUND

Various types of rifles and other firearms are configured to eject spent ammunition cases. In automatic and semi-automatic rifles, the cases are ejected automatically after the bullets are fired from the cases. Other types of rifles are configured for manual ejection of cases, such as by throwing a bolt lever or pumping a stock. Ejected cases can scatter around a shooting area and need to be retrieved for reloading or discarding. Ejected cases can also be hot and pose a safety risk. Some firearm mounted catchers for catching and collecting ejected cases are known.

SUMMARY

In one aspect, a cartridge case catcher is for catching cartridges ejected from an action of a firearm. The cartridge case catcher includes a mount configured to mount to the firearm. A receptacle has a case compartment sized for carrying cases ejected from the action. The receptacle has a mouth providing access to the case compartment. A pivot connection connects the receptacle to the mount. The pivot connection is configured to permit movement of the receptacle with respect to the mount and firearm about the pivot connection between an operational orientation to receive cases ejected from the firearm action through the mouth into the case compartment and an access orientation in which the mouth of the receptacle is spaced farther away from the action than in the operational orientation to permit access to the action of the firearm.

In another aspect, a method is for catching cartridges ejected from an action of a firearm. The method includes mounting a cartridge case catcher on the firearm and firing the firearm. Cases ejected from the action of the firearm are caught in a receptacle of the cartridge case catcher while the receptacle is supported by the firearm and in an operational orientation. Without dismounting the cartridge case catcher from the firearm, the cartridge case catcher is reconfigured to move the receptacle to an access orientation in which the receptacle is supported by the firearm and permits access to a jammed cartridge or stuck case in the action. The jammed cartridge or stuck case in the action is cleared. The cartridge case catcher is reconfigured to move the receptacle back to the operational orientation.

In yet another aspect, a cartridge case catcher is for catching cartridges ejected from an action of a firearm. The cartridge case catcher includes a mount and a receptacle supported by the mount. The mount includes a brace and at least first and second fasteners. The first and second fasteners are each configured to secure the brace to the firearm. The brace has a firearm axis that extends generally parallel with a longitudinal axis of the firearm when the mount is mounted on the firearm. The first and second fasteners are spaced from each other along the firearm axis. The receptacle has a case compartment sized for carrying cases ejected from the action. The receptacle has a mouth providing access to the case compartment for receipt of cases therein.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
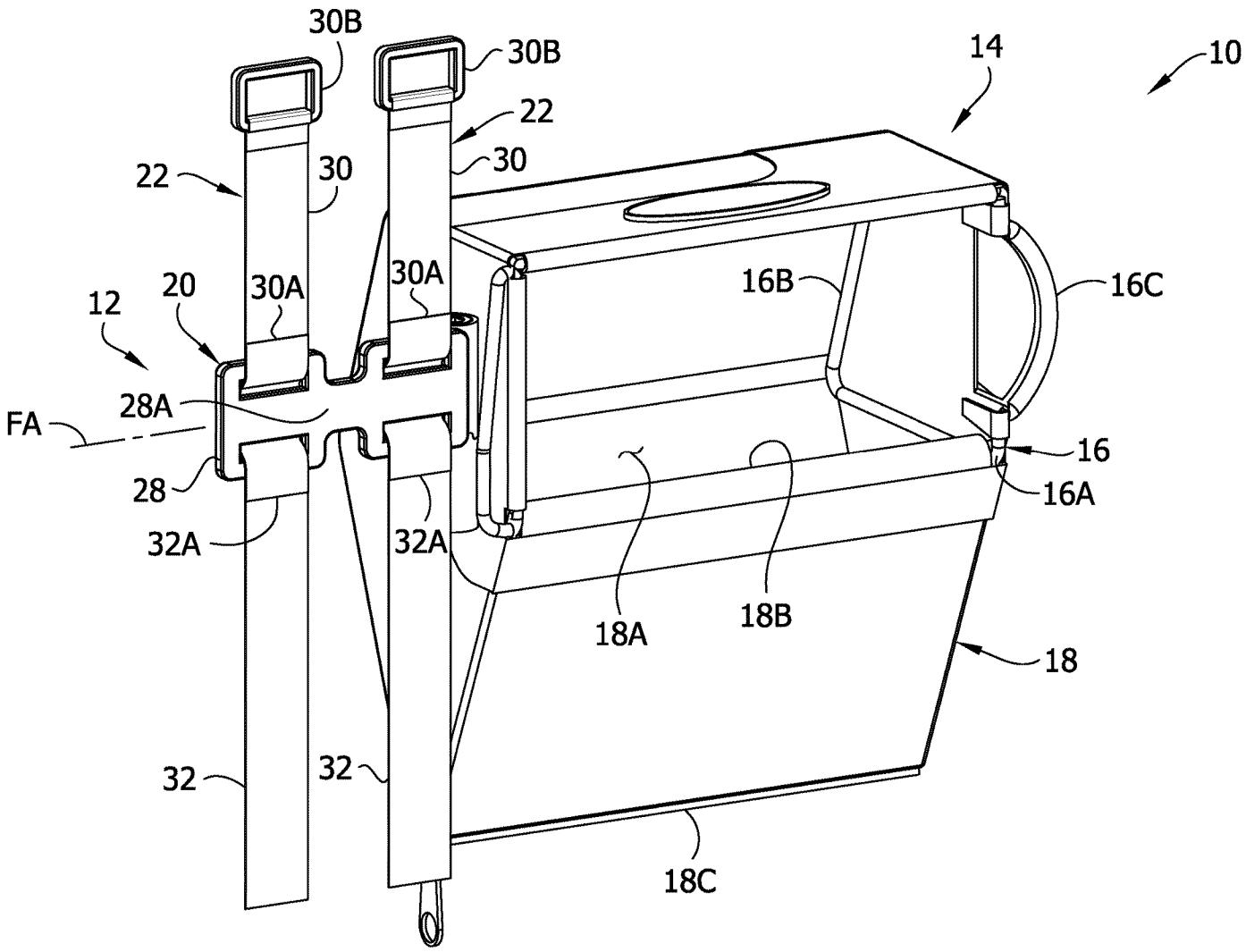
FIG. 1 is a front perspective of a cartridge case catcher.
Figure 2:
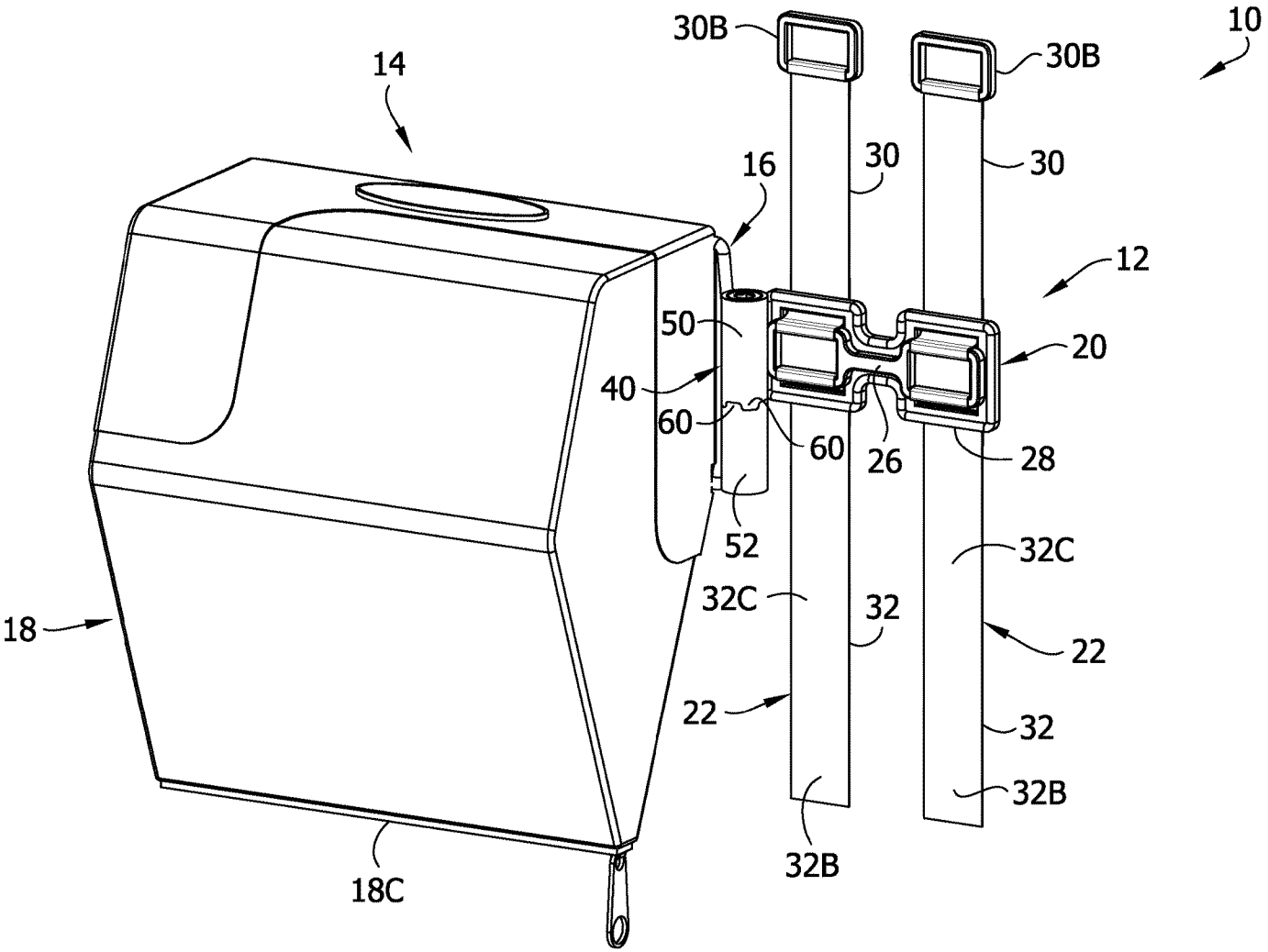
FIG. 2 is a rear perspective of the cartridge case catcher.
Figure 9:
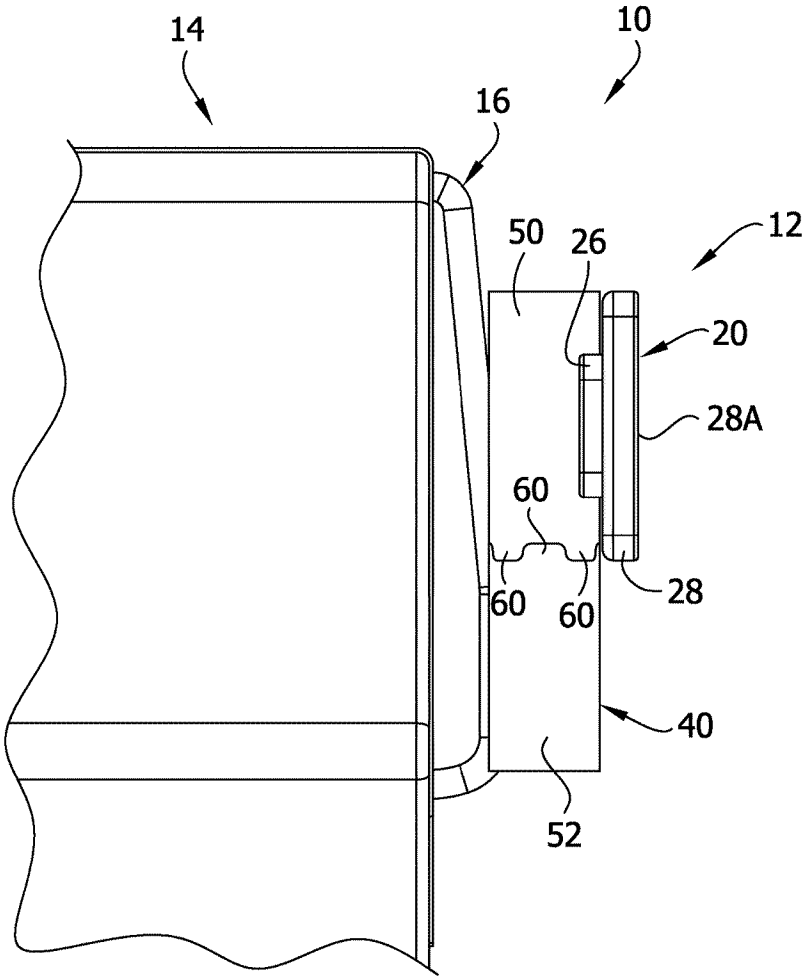
FIG. 9 is a view similar to FIG. 7 but showing the mount pivoted about 90 degrees out of the page such that the receptacle is in the access orientation.

Referring to FIGS. 1 and 2, a firearm mountable ammunition case catcher embodying aspects of the present invention is designated generally by the reference number 10. As explained in further detail below, the case catcher 10 is configured to be mounted on a firearm F and to catch ammunition cases ejected from an action A of the firearm. For example, the catcher 10 is shown mounted on an AR-15 rifle in FIGS. 3 and 4. The catcher generally includes a mount 12 for mounting on the firearm F and a receptacle 14 for catching the ejected cases. The receptacle 12 is movable with respect to the mount between an operational orientation (e.g., FIGS. 1-3, 5, 6) for catching the cases and an access orientation (e.g., FIGS. 4, 9) in which the receptacle is oriented to permit user access to the action of the firearm without removing the mount from the firearm. It will be appreciated that in other embodiments, the access orientation could be different than illustrated.

Figure 4:
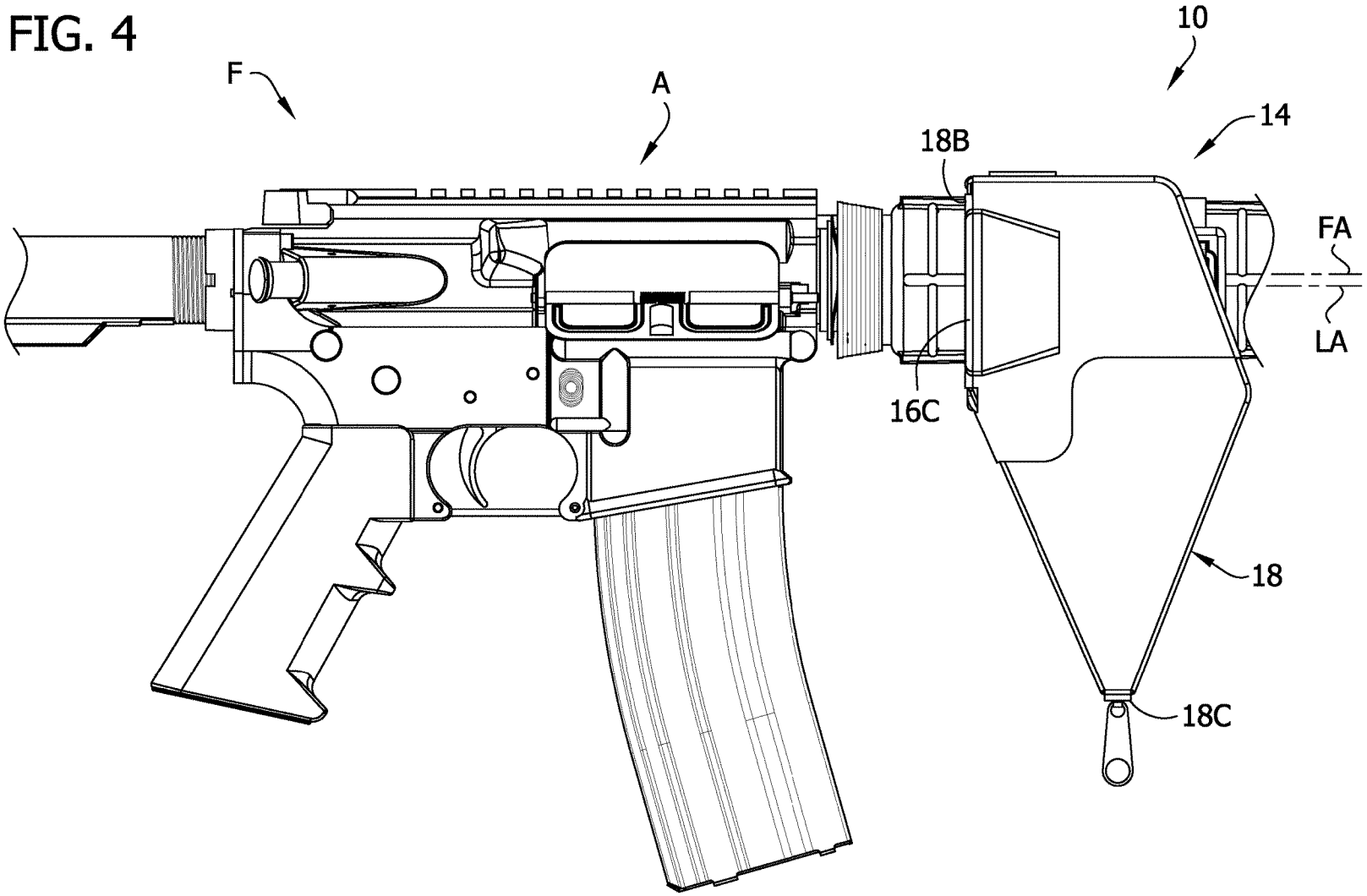
FIG. 4 is an elevation similar to FIG. 3 but showing the cartridge case catcher in an access orientation.

Referring to FIGS. 1 and 2, the receptacle 14 includes a support in the form of a frame 16 and a container in the form of a bag 18. The bag 18 defines a case compartment 18A (FIG. 1) sized for carrying cases ejected from the action A (FIG. 4). The bag has an opening 18B (FIG. 1) defining the mouth of the receptacle 14. The frame 16 supports the bag 18 to maintain the mouth 18B open and to maintain the case compartment 18A generally open for receiving cases therein. The frame 16 includes a rectangular mouth portion 16A to which the bag 18 is secured around the bag opening 18B. The frame 16 also includes two props 16B (only one of which is shown in FIG. 1) extending rearward at left and right sides of the mouth portion 16A for supporting the bag 18. The right side of the mouth portion 16A defines a handle 16C for use in pivoting the receptacle 14, which will be explained in further detail below. The frame 16 can be made of metal, and the bag 18 can be formed of fabric (e.g., nylon material and/or mesh material). The bag 18 has a zippered bottom opening 18C that can be selectively opened to empty cases from the case compartment 18A. Receptacles having other configurations can be used without departing from the scope of the present invention. For example, other types of containers can be used in place of the bag 18, and the frame can have other constructions or be omitted.

Figure 3:
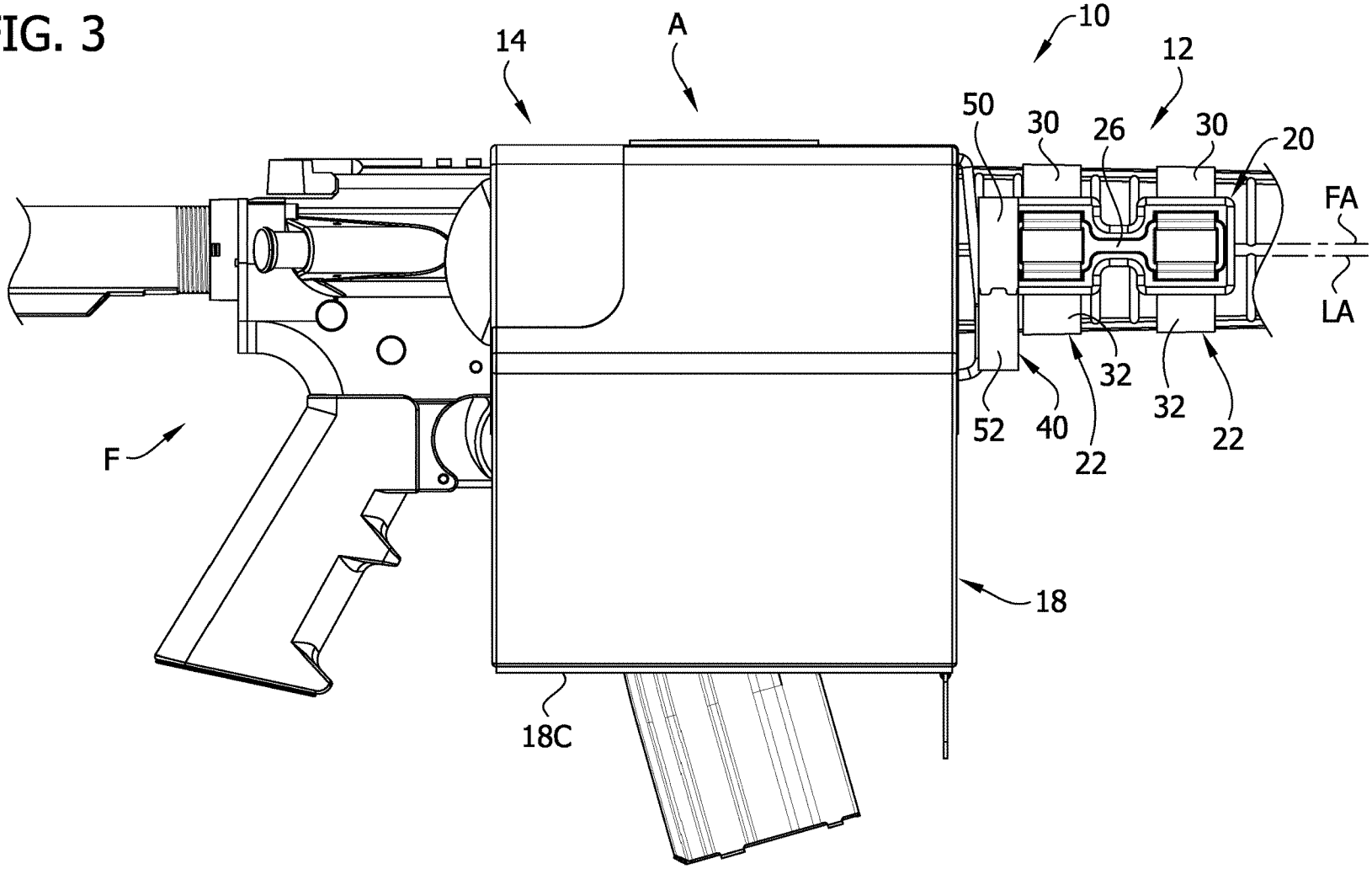
FIG. 3 is a rear elevation of the cartridge case catcher mounted on a firearm in an operational orientation.
Figure 8:
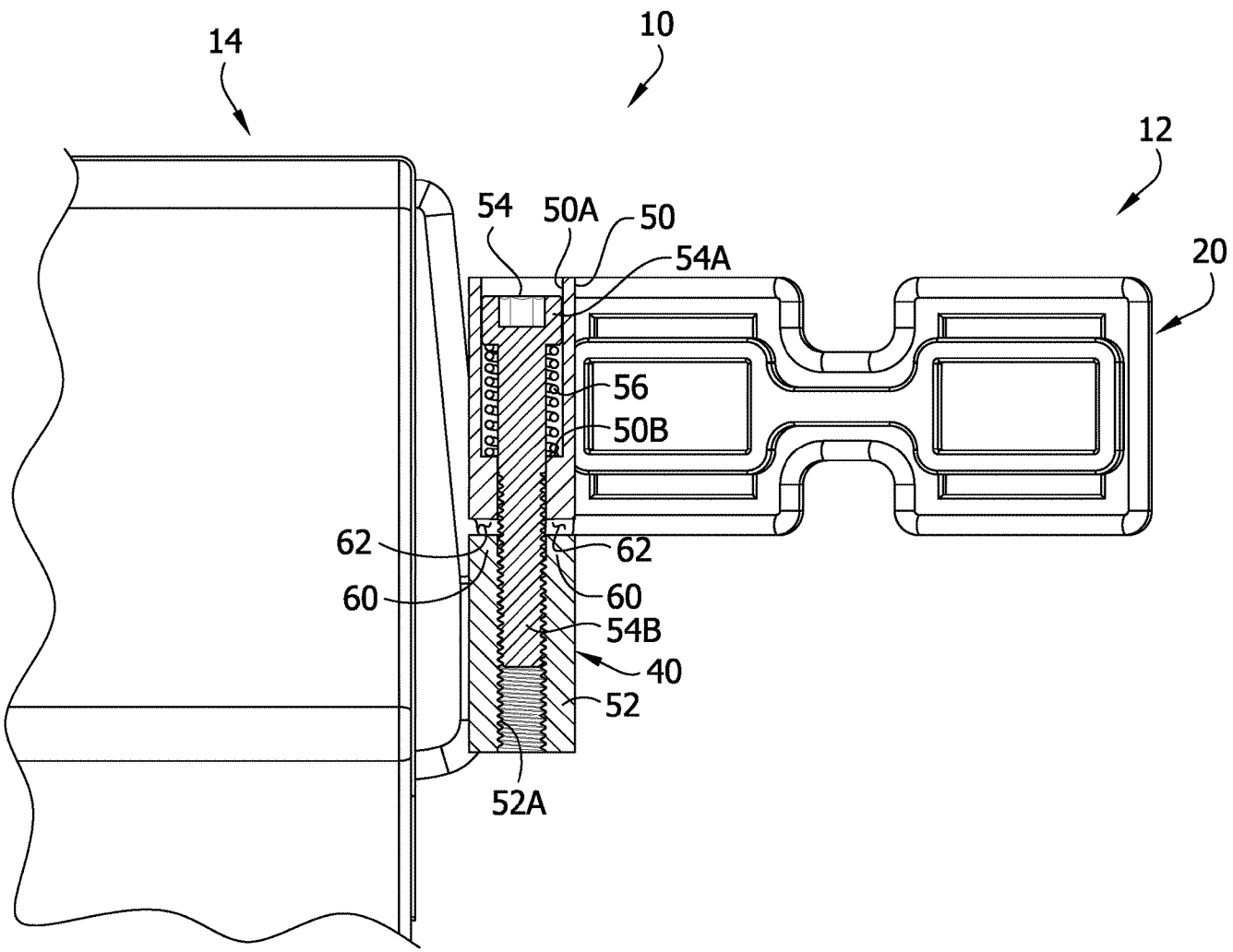
FIG. 8 is a view similar to FIG. 7 but showing the pivot connection in section.
Figure 10:
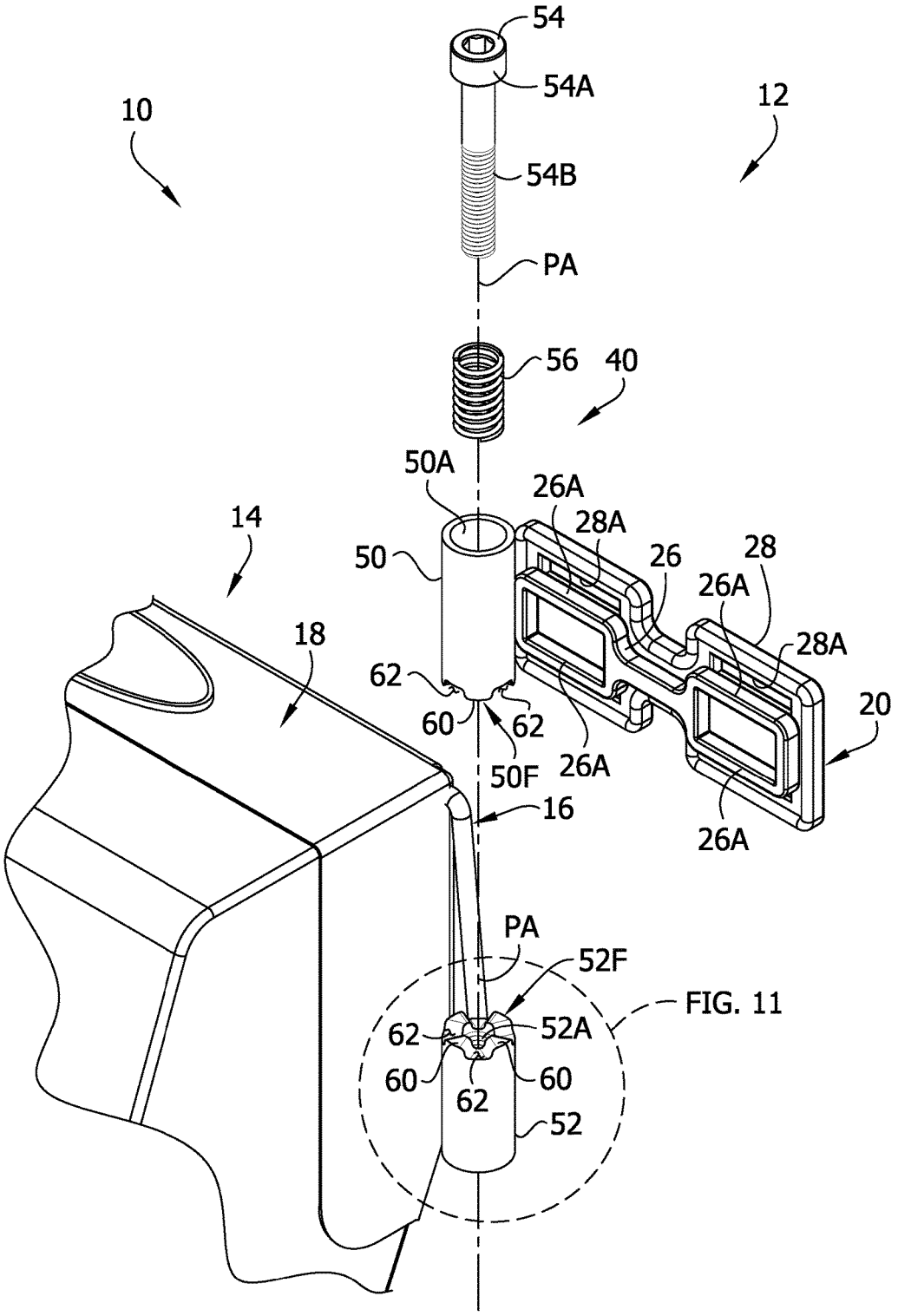
FIG. 10 is an exploded fragmentary rear perspective of the cartridge case catcher showing components of the pivot connection.

Referring to FIGS. 1, 2, and 10, the mount 12 generally includes a brace 20 and two fasteners 22 for mounting to the firearm F. The brace 20 includes a bracket 26 having a generally FIG. 8 shape and a protective pad 28 on an inner surface of the bracket. The protective pad 28 defines a firearm engagement surface 28A of the mount 12. The brace 20 can be made of a suitable material such as metal, and the protective pad 28 can be made of elastomeric material or other suitable material. When the brace 20 is applied to the firearm F, the firearm engagement surface 28A of the pad 28 directly engages the firearm F (e.g., on a handguard of the firearm as shown in FIGS. 3 and 4), and the fasteners 22 hold the brace 20 in position on the firearm. The brace 20 has a firearm axis FA that extends along a longitudinal axis LA of the firearm F when the brace is mounted on the firearm (see, FIG. 3). In the illustrated embodiment, the firearm axis FA of the brace 20 is the longitudinal axis of the brace.

The fasteners 22 are provided in the form of two straps spaced from each other along the length of the brace 20. The straps 22 each include an upper strap portion 30 and a lower strap portion 32. The strap portions 30, 32 include proximal ends wrapped around respective fastener attachment segments 26A of the bracket 26 (FIGS. 5, 10) and secured (e.g., stitched at 30A, 32A in FIG. 1) to themselves to secure the strap portions to the bracket. The protective pad 28 is held in position with respect to the bracket 26 by threading of the strap portions 30, 32 through respective openings 28A in the pad 28. Alternatively, the pad 28 could be adhered to or overmolded onto the bracket 26. The upper strap portions 30 have buckles 30B at their distal free ends through which distal free ends of the lower strap portions 32 are threaded to mount onto a firearm. The lower strap portions 32 have hook material on one surface (e.g., indicated at 32B in FIG. 2) and loop material on an opposite surface (e.g., indicated at 32C in FIG. 2). When the lower strap portions 32 are threaded through the buckles 30B, the lower strap portions can be pulled through the buckles and folded over themselves to cinch the straps 22 around the firearm F. The straps 22 can be independently adjusted (cinched different amounts) to conform to respective portions of the firearm F over which the straps 22 are wrapped. The straps 22 can be releasably secured in their cinched configurations by applying the hook material 32B against the loop material 32C.

It will be appreciated that providing multiple fasteners 22 and spacing the fasteners along the firearm axis FA of the brace 20 provides several benefits. For example, the multiple fasteners 22 securely hold the brace on the firearm to prevent the cantilevered receptacle from sagging. The weight of the receptacle 12 applies a force on the brace tending to cause the receptacle to sag when the catcher 10 is mounted on the firearm F. The tendency to sag is increased when several cases are held in the receptacle 12 and thus add weight. In other words, the weight of the receptacle 12 and cases tends to cause the firearm axis FA of the brace 20 to rotate out of its generally parallel relationship with the longitudinal axis LA of the firearm F. If one fastener were provided for securing the brace to the firearm F, the brace may pivot about the fastener, permitting the receptacle to sag. With the two fasteners 22, the brace is substantially prevented from pivoting about either of the fasteners and thus prevents receptacle sag. Desirably, the material of the pad 28 (e.g., resiliently compressible material) is selected to provide high friction against the firearm and assists the multiple fasteners 22 in preventing receptacle sag. The multiple fasteners 22 also securely support the brace 20 against movement when a user is moving the receptacle 12 between the operational and access positions.

Other types of mounts can be used without departing from the scope of the present invention. For example, other types of braces and fasteners (e.g., other types of straps, clamps, firearm connectors, etc.) can be used. Moreover, other numbers of fasteners, such as one, three, four, etc. can be used.

Figure 5:
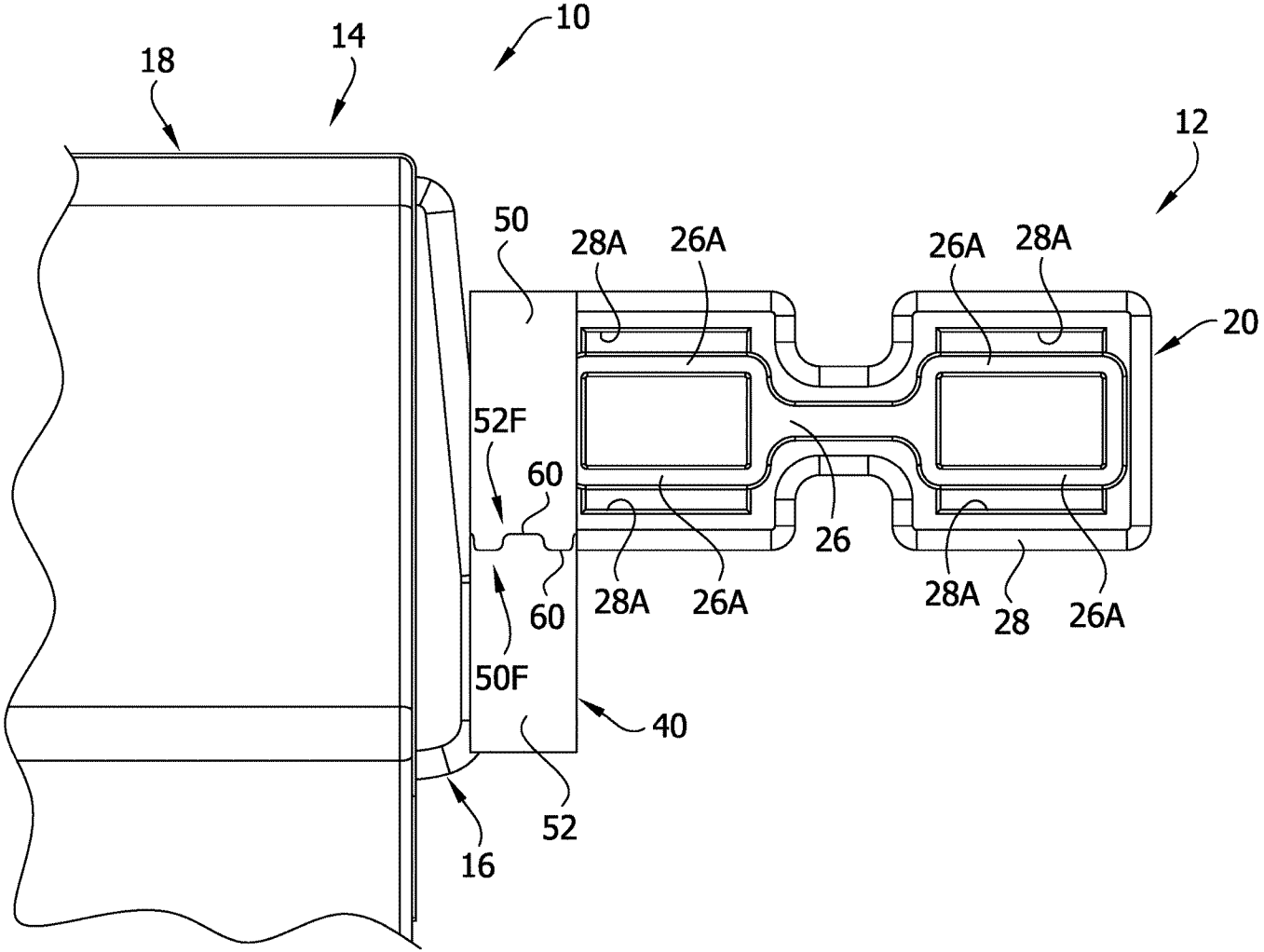
FIG. 5 is a fragmentary rear elevation of the cartridge case catcher in the operational orientation.
Figure 6:
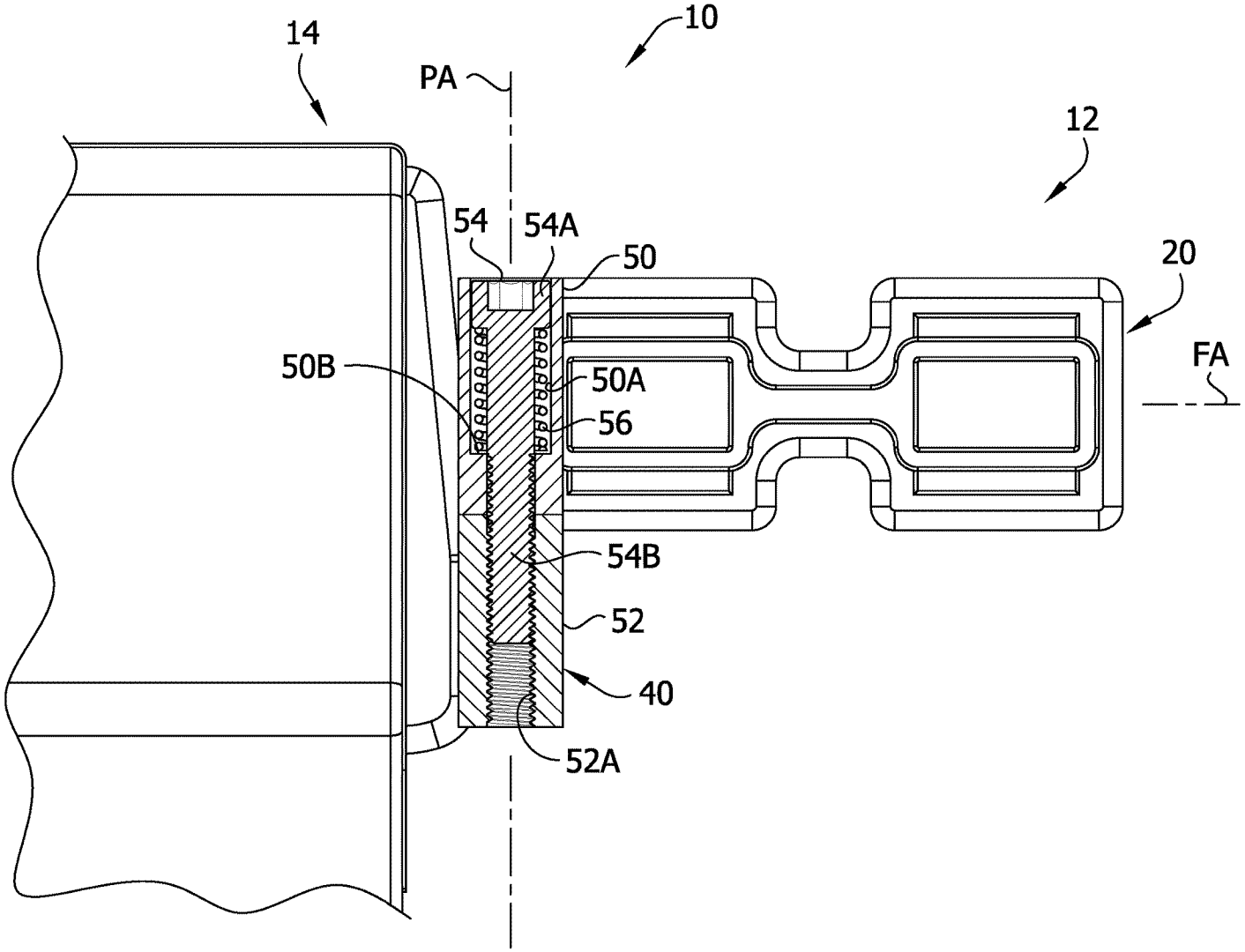
FIG. 6 is a view similar to FIG. 5 but showing a pivot connection of the cartridge case catcher in section.
Figure 7:
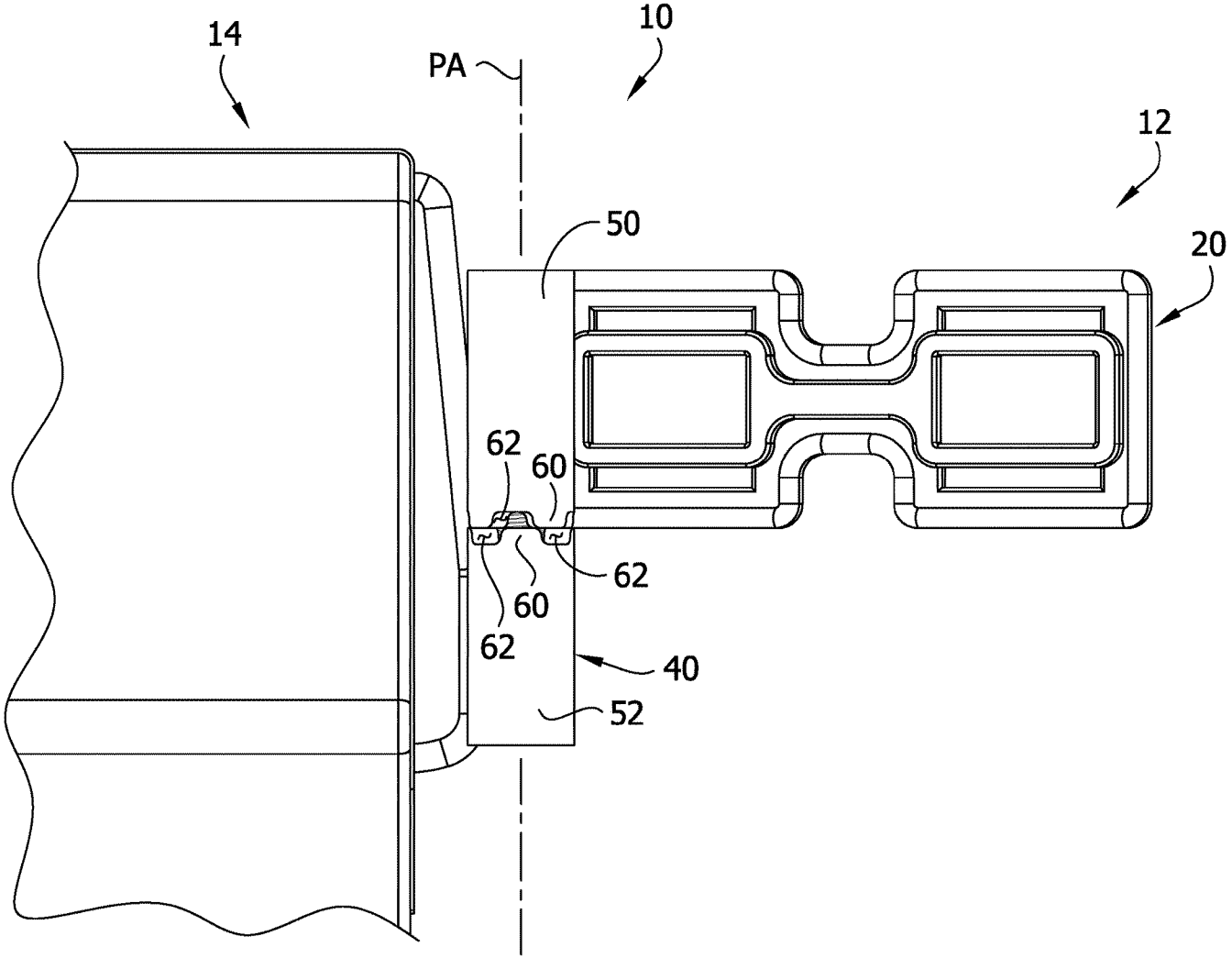
FIG. 7 is a view similar to FIG. 5 but showing the mount pivoted about 45 degrees out of the page such that the receptacle is out of the operational orientation.

Referring to FIGS. 5, 6, and 10, the catcher 10 includes a pivot connection 40 joining the receptacle 14 to the mount 12. The receptacle 14 is pivotable with respect to the mount 12 about the pivot connection between the operational orientation and the access orientation. As shown in FIG. 3, when the receptacle 14 is in the operational orientation, and the catcher 10 is suitably mounted on a firearm F, the mouth 18B faces and overlies the action A of the firearm for receiving ejected ammunition cases into the case compartment 18A. In the operational orientation, the mouth 18B is generally parallel with the brace 20 such that the mouth extends generally parallel with the firearm axis FA of the brace. The receptacle 14 is movable to the access orientation by pivoting the receptacle in a direction away from the firearm action A. The straps 22 spaced along the length of the brace 20 assist in maintaining the brace securely on the firearm as the receptacle is pivoted. As shown in FIG. 4, when the receptacle 14 is in the access orientation, the receptacle is still supported by the firearm F but is spaced farther from the action A of the firearm F to permit the user to access the action without dismounting the catcher 10 from the firearm or disconnecting the receptacle 14 from the mount 12. For example, the user may need to access the action A to clear a jammed cartridge or stuck case. The movability of the receptacle 14 makes accessing the action A more convenient and less time consuming than if the mount 12 were required to be removed from and then remounted on the firearm. In the access orientation, the mouth 18B extends outward from the firearm F and transverse to the firearm axis FA of the mount 12. Although the mouth 18B is shown at a 90 degree angle with respect to the firearm axis FA in the illustrated access orientation, other transverse relationships (e.g., other angles) may be used without departing form the scope of the present invention. The user can move the receptacle 14 back to the operational orientation by pivoting the receptacle toward the action A.

Referring to FIGS. 6 and 10, the pivot connection 40 includes a first pivot connector 50 secured to the mount 12 (e.g., welded to the brace 20) and a second pivot connector 52 secured to the receptacle 14 (e.g., welded to the frame 16). The pivot connection 40 also includes a fastener 54 and a coil spring 56. The components of the pivot connection 40 can be formed of metal or another suitable material. The fastener 54 secures the first pivot connector 50 to the second pivot connector 52. In the illustrated embodiment, the pivot connectors 50, 52 are generally cylindrical fittings, and the fastener 54 is a bolt having a head 54A and a threaded shaft 54B. As shown in FIG. 6, the bolt 54 is received in a smooth bore 50A of the first pivot connector 50 and is threaded into a threaded bore 52A of the second connector 52. The bolt 54 defines a pivot axis PA of the pivot connection 40 about which the receptacle 14 is pivotable with respect to the mount 12. Still referring to FIG. 6, the bolt shaft 54B extends through the center of the spring 56, and the head 54A of the bolt compresses the spring against a shoulder 50B in the bore 50A of the first pivot connector 50. The arrangement is such that the spring 56 biases a lower face 50F (FIG. 10) of the first pivot connector 50 against an upper face 52F (FIGS. 10, 11) of the second pivot connector 52.

The faces 50F, 52F of the first and second pivot connectors 50, 52 are configured to act in conjunction with the fastener 54 and spring 56 to provide a detent arrangement to releasably retain the receptacle 14 in the operational orientation and releasably retain the receptacle in the access orientation. The upper face 52F of the second pivot connector 52 is shown in detail in FIG. 11, and it will be understood that the lower face 50F of the first pivot connector 50 has essentially the same construction. The faces 50F, 52F each include a plurality of lugs 60 and recesses 62 between the lugs. The lugs 60 can be referred to broadly as retainers or detents. When the lugs 60 are received in the recesses 62, the lugs resist rotation of the receptacle 14 with respect to the mount 12 about the pivot axis PA. The spring 56 biases the faces 50F, 52F into engagement with one another such that the lugs 60 are biased into the recesses 62. As shown by comparison of FIGS. 5 and 6 to FIGS. 7 and 8, application of sufficient force to the receptacle 14 (e.g., at the handle 16C) tending to pivot the receptacle about the pivot axis PA causes the lugs 60 to ramp out of the recesses 62 against the bias of the spring 56 and thus permit rotation of the receptacle 14 from the operational or access orientation to the other of the operational and access orientation. As shown by comparison of FIGS. 6 and 8, ramping of the lugs 60 out of the recesses 62 causes the spring 56 to compress. More specifically, the receptacle pivot connector 52 moves downward relative to the mount pivot connector 50 such that the spring 56 is compressed between the bolt head 54A and the shoulder 50B of the mount pivot connector 50, thus decreasing the length of the spring. Accordingly, the detent arrangement is releasable by application of force to the receptacle 14 tending to pivot the receptacle in a direction toward the desired new orientation. As the receptacle 14 is pivoted to reach the operational or access orientation, the lugs 60 of the first and second pivot connectors 50, 52 "snap" into the recesses 62 under the bias of the spring 56 to releasably maintain the receptacle in that orientation. The fitment of the lugs 60 in the recesses 62 predetermines the operational and access orientations of the receptacle with respect to the mount. When the lugs 60 are received in the recesses 62, the lugs may be said to be in retaining positions, and when the lugs are out of the recesses, the detents may be said to be in non-retaining positions.

Figure 11:
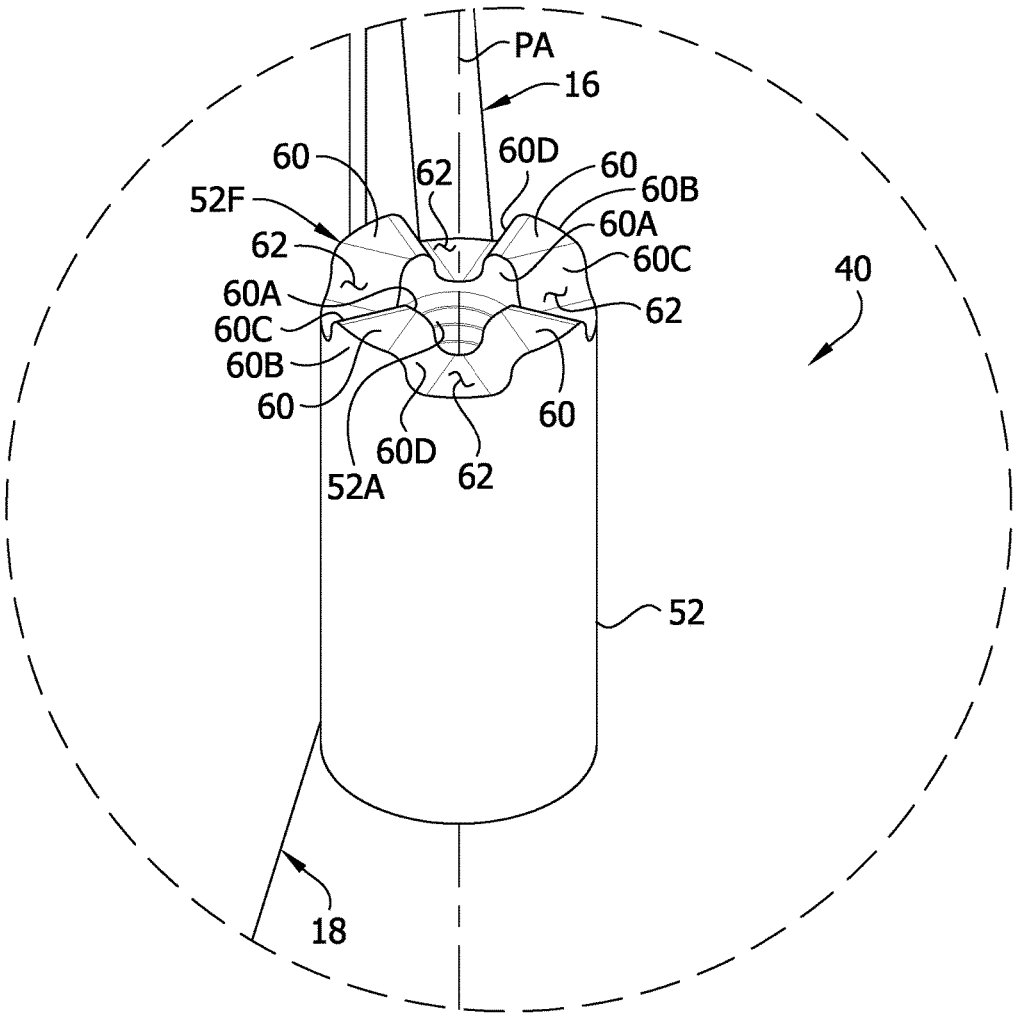
FIG. 11 is an enlarged view of a portion of FIG. 10 showing details of a pivot connector of the pivot connection.

Referring to FIG. 11, the lugs 60 on the upper face 52F of the receptacle pivot connector 52 each have an inner side 60A facing the threaded bore 52A of the connector 52 (facing the pivot axis PA) and an outer side 60B facing away from the threaded bore. It will be appreciated that the lugs 60 of the lower face 50F of the mount pivot connector 50 have a similar construction. Each lug 60 has a first intermediate surface 60C that extends between the inner and outer sides 60A, 60B of the lug 60 and also defines a portion of an adjacent recess 62. Each lug 60 has a second intermediate surface 60D opposite the first intermediate surface 60C that extends between the inner and outer sides 60A, 60B and defines a portion of an opposite adjacent recess 62. The lug intermediate surfaces 60C, 60D are ramped and extend in directions radially outward from the pivot axis PA. The arrangement is such that the ramped intermediate surfaces 60C, 60D of the lugs 60 of the first and second pivot connectors 50, 52 engage each other conformally to facilitate the automatic withdrawal of the lugs 60 from the recesses 62 responsive to application of force on the receptacle 14 tending to pivot it about the pivot axis.

It will be appreciated that other arrangements permitting movement of the receptacle between the operational and access orientations can be used without departing from the scope of the present invention. For example, other types of connections and/or additional connections (pivot connections, slide connections, etc.) can be used. A pivot connection could permit pivoting about more than a single pivot axis to move the receptacle. Other configurations can also be used to releasably retain the receptacle in the operational or access orientations. For example, fewer retainers or detents (e.g., one) may be provided, and the retainer or detent may not automatically be released by application of force tending to pivot the receptacle toward the next desired orientation. Moreover, retainers having other configurations and/or mounted elsewhere than on a pivot connector can be used. Other types of springs can be used, and the spring can be omitted or provided as an integrated component of another part of the pivot connection.

In a method of using the catcher, the mount 12 may be secured to the firearm F as shown in FIG. 3 such that the mouth 18B of the receptacle 14 overlies the action A or case ejection port of the firearm F when the receptacle is in the operational orientation. The firearm F can be fired several times, and cases can be ejected into the receptacle 14. If a jam occurs in the action A, or the user otherwise needs to access the action, the user can pull the handle 16C away from the firearm F to pivot the receptacle 14 to the access orientation such as shown in FIG. 4. When the user desires to continue shooting, the receptacle 14 can be moved back to the operational orientation by applying force to the receptacle tending to pivot it in that direction. The detent arrangement of the pivot connection 40 releasably maintains the receptacle 14 in the operational and access orientations.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A cartridge case catcher for catching cartridges ejected from an action of a firearm, the firearm having a longitudinal axis extending along a length of the firearm between forward and rearward portions of the firearm, the cartridge case catcher comprising:

a mount configured to mount to the firearm;

a receptacle having a case compartment sized for carrying cases ejected from the action, the receptacle having a mouth providing access to the case compartment, the mouth including a top, a bottom, and opposite sides, the mouth having a height extending between the top and the bottom and a width extending between the opposite sides; and a pivot connection connecting the receptacle to the mount, the pivot connection defining a pivot axis about which the receptacle is pivotable with respect to the mount and firearm when the mount is mounted on the firearm, the receptacle being pivotable about the pivot axis between an operational orientation to receive cases ejected from the firearm action through the mouth into the case compartment and an access orientation in which the width of the mouth extends transversely with respect to the longitudinal axis of the firearm away from the action of the firearm to permit access to the action, the pivot axis extending heightwise with respect to the mouth such that the receptacle is pivotable forward and rearward with respect to the firearm about the pivot axis between the operational and access orientations when the mount is mounted on the firearm;

wherein the pivot connection includes a retainer configured to releasably retain the receptacle in the operational orientation;

wherein the retainer comprises a detent;

wherein the detent is spring biased into a retaining position in which the detent releasably retains the receptacle in the operational orientation.

2. The cartridge case catcher as set forth in claim 1, wherein the pivot connection includes a recess in which the detent is receivable to releasably retain the receptacle in the operational orientation.

3. The cartridge case catcher as set forth in claim 1, wherein the receptacle is movable about the pivot connection in a first direction to move the receptacle from the operational orientation to the access orientation, and the detent is movable out of the retaining position against the spring bias by application of force on the receptacle tending to move the receptacle in the first direction.

4. The cartridge case catcher as set forth in claim 1, wherein the pivot connection is configured to releasably retain the receptacle in the access orientation.

5. The cartridge case catcher as set forth in claim 1, wherein at least one of the mount and the receptacle includes a first pivot connector and the other of the mount and the receptacle includes a second pivot connector, the first and second pivot connectors secured to each other and at least partially defining the pivot connection.

6. The cartridge case catcher as set forth in claim 5, wherein at least one of the first and second pivot connectors includes the retainer and the other of the first and second pivot connectors includes a retainer recess sized to at least partially receive the retainer to releasably retain the receptacle in the operational orientation.

7. The cartridge case catcher as set forth in claim 6, wherein the pivot connection includes a fastener securing the first pivot connector to the second pivot connector.

8. The cartridge case catcher as set forth in claim 1, wherein the mount comprises a brace and at least one fastener configured to secure the brace to the firearm, the brace configured to extend from a side of the mouth forward along the firearm when the mount is mounted on the firearm and the receptacle is in the operational orientation.

9. A cartridge case catcher for catching cartridges ejected from an action of a firearm, the firearm having a longitudinal axis extending along a length of the firearm between forward and rearward portions of the firearm, the cartridge case catcher comprising:

a mount configured to mount to the firearm;

a receptacle having a case compartment sized for carrying cases ejected from the action, the receptacle having a mouth providing access to the case compartment, the mouth including a top, a bottom, and opposite sides, the mouth having a height extending between the top and the bottom and a width extending between the opposite sides; and a pivot connection connecting the receptacle to the mount, the pivot connection defining a pivot axis about which the receptacle is pivotable with respect to the mount and firearm when the mount is mounted on the firearm, the receptacle being pivotable about the pivot axis between an operational orientation to receive cases ejected from the firearm action through the mouth into the case compartment and an access orientation in which the width of the mouth extends transversely with respect to the longitudinal axis of the firearm away from the action of the firearm to permit access to the action, the pivot axis extending heightwise with respect to the mouth such that the receptacle is pivotable forward and rearward with respect to the firearm about the pivot axis between the operational and access orientations when the mount is mounted on the firearm;

wherein the pivot connection includes a retainer configured to releasably retain the receptacle in the operational orientation;

wherein at least one of the mount and the receptacle includes a first pivot connector and the other of the mount and the receptacle includes a second pivot connector, the first and second pivot connectors secured to each other and at least partially defining the pivot connection;

wherein at least one of the first and second pivot connectors includes the retainer and the other of the first and second pivot connectors includes a retainer recess sized to at least partially receive the retainer to releasably retain the receptacle in the operational orientation;

wherein the retainer is biased into the retainer recess;

wherein the retainer is movable out of the recess by application of force to the receptacle tending to move the receptacle about the pivot connection from the operational orientation to the access orientation.

10. A cartridge case catcher for catching cartridges ejected from an action of a firearm, the firearm having a longitudinal axis extending along a length of the firearm between forward and rearward portions of the firearm, the cartridge case catcher comprising:

a mount configured to mount to the firearm;

a receptacle having a case compartment sized for carrying cases ejected from the action, the receptacle having a mouth providing access to the case compartment, the mouth including a top, a bottom, and opposite sides, the mouth having a height extending between the top and the bottom and a width extending between the opposite sides; and a pivot connection connecting the receptacle to the mount, the pivot connection defining a pivot axis about which the receptacle is pivotable with respect to the mount and firearm when the mount is mounted on the firearm, the receptacle being pivotable about the pivot axis between an operational orientation to receive cases ejected from the firearm action through the mouth into the case compartment and an access orientation in which the width of the mouth extends transversely with respect to the longitudinal axis of the firearm away from the action of the firearm to permit access to the action, the pivot axis extending heightwise with respect to the mouth such that the receptacle is pivotable forward and rearward with respect to the firearm about the pivot axis between the operational and access orientations when the mount is mounted on the firearm;

wherein the pivot connection includes a retainer configured to releasably retain the receptacle in the operational orientation;

wherein at least one of the mount and the receptacle includes a first pivot connector and the other of the mount and the receptacle includes a second pivot connector, the first and second pivot connectors secured to each other and at least partially defining the pivot connection;

wherein at least one of the first and second pivot connectors includes the retainer and the other of the first and second pivot connectors includes a retainer recess sized to at least partially receive the retainer to releasably retain the receptacle in the operational orientation;

wherein the pivot connection includes a fastener securing the first pivot connector to the second pivot connector;

wherein the pivot connection includes a spring biasing the retainer into the retainer recess, and the spring defines an opening through which the fastener extends.

11. A cartridge case catcher for catching cartridges ejected from an action of a firearm, the firearm having a longitudinal axis extending along a length of the firearm between forward and rearward portions of the firearm, the cartridge case catcher comprising:

a mount configured to mount to the firearm;

a receptacle having a case compartment sized for carrying cases ejected from the action, the receptacle having a mouth providing access to the case compartment, the mouth including a top, a bottom, and opposite sides, the mouth having a height extending between the top and the bottom and a width extending between the opposite sides; and a pivot connection connecting the receptacle to the mount, the pivot connection defining a pivot axis about which the receptacle is pivotable with respect to the mount and firearm when the mount is mounted on the firearm, the receptacle being pivotable about the pivot axis between an operational orientation to receive cases ejected from the firearm action through the mouth into the case compartment and an access orientation in which the width of the mouth extends transversely with respect to the longitudinal axis of the firearm away from the action of the firearm to permit access to the action, the pivot axis extending heightwise with respect to the mouth such that the receptacle is pivotable forward and rearward with respect to the firearm about the pivot axis between the operational and access orientations when the mount is mounted on the firearm;

wherein the pivot connection includes a retainer configured to releasably retain the receptacle in the operational orientation;

wherein at least one of the mount and the receptacle includes a first pivot connector and the other of the mount and the receptacle includes a second pivot connector, the first and second pivot connectors secured to each other and at least partially defining the pivot connection;

wherein at least one of the first and second pivot connectors includes the retainer and the other of the first and second pivot connectors includes a retainer recess sized to at least partially receive the retainer to releasably retain the receptacle in the operational orientation;

wherein said retainer is a first retainer and said retainer recess is a first retainer recess, said at least one of the first and second pivot connectors includes a second retainer, and said other of the first and second pivot connectors includes a second retainer recess sized to at least partially receive the second retainer to releasably retain the receptacle in the operational orientation.

12. A cartridge case catcher for catching cartridges ejected from an action of a firearm, the firearm having a longitudinal axis extending along a length of the firearm between forward and rearward portions of the firearm, the cartridge case catcher comprising:

a mount configured to mount to the firearm;

a receptacle having a case compartment sized for carrying cases ejected from the action, the receptacle having a mouth providing access to the case compartment, the mouth including a top, a bottom, and opposite sides, the mouth having a height extending between the top and the bottom and a width extending between the opposite sides; and a pivot connection connecting the receptacle to the mount, the pivot connection defining a pivot axis about which the receptacle is pivotable with respect to the mount and firearm when the mount is mounted on the firearm, the receptacle being pivotable about the pivot axis between an operational orientation to receive cases ejected from the firearm action through the mouth into the case compartment and an access orientation in which the width of the mouth extends transversely with respect to the longitudinal axis of the firearm away from the action of the firearm to permit access to the action, the pivot axis extending heightwise with respect to the mouth such that the receptacle is pivotable forward and rearward with respect to the firearm about the pivot axis between the operational and access orientations when the mount is mounted on the firearm;

wherein the pivot connection includes a retainer configured to releasably retain the receptacle in the operational orientation;

wherein at least one of the mount and the receptacle includes a first pivot connector and the other of the mount and the receptacle includes a second pivot connector, the first and second pivot connectors secured to each other and at least partially defining the pivot connection;

wherein at least one of the first and second pivot connectors includes the retainer and the other of the first and second pivot connectors includes a retainer recess sized to at least partially receive the retainer to releasably retain the receptacle in the operational orientation;

wherein the retainer has an inner side facing the pivot axis and an outer side spaced from the inner side radially outward from the pivot axis, the retainer having a first intermediate surface between the inner and outer sides extending in a direction radially from the pivot axis.

13. The cartridge case catcher as set forth in claim 12, wherein the retainer includes a ramp extending along said first intermediate surface, the ramp constructed to remove the retainer from the retainer recess responsive to force on the receptacle tending to move the receptacle about the pivot axis from the operational orientation toward the access orientation.

14. The cartridge case catcher as set forth in claim 13, wherein the retainer includes a second intermediate surface between the inner and outer sides extending in a direction radially from the pivot axis, and the retainer includes a ramp extending along said second intermediate surface constructed to remove the retainer from the retainer recess responsive to force on the receptacle tending to move the receptacle about the pivot axis from the access orientation toward the operational orientation.

15. A cartridge case catcher for catching cartridges ejected from an action of a firearm, the cartridge case catcher comprising:

a mount including a brace and at least first and second fasteners, the first and second fasteners each configured to secure the brace to the firearm; and a receptacle supported by the mount, the receptacle having a case compartment sized for carrying cases ejected from the action, the receptacle having a mouth providing access to the case compartment for receipt of cases therein, the mouth having a top, a bottom, and opposite first and second sides, the first side being spaced laterally from the second side in a first direction;

wherein the brace extends laterally away from the first side of the mouth in the first direction such that, when the first and second fasteners are secured to the firearm and the mouth of the receptacle is positioned to receive cases from the action, the first and second fasteners are located laterally from the first side of the mouth in the first direction, and the second fastener is spaced from the first fastener in the first direction.

16. A cartridge case catcher for catching cartridges ejected from an action of a firearm, the cartridge case catcher comprising:

a mount configured to mount to the firearm;

a receptacle having a case compartment sized for carrying cases ejected from the action, the receptacle having a mouth providing access to the case compartment;

a pivot connection connecting the receptacle to the mount, the pivot connection being configured to permit movement of the receptacle with respect to the mount and firearm about the pivot connection between an operational orientation to receive cases ejected from the firearm action through the mouth into the case compartment and an access orientation in which the mouth of the receptacle is spaced away from the action to permit access to the action; and wherein the pivot connection includes a detent biased to a retaining position in which the detent releasably retains the receptacle in the operational orientation, the receptacle is movable about the pivot connection in a first direction to move the receptacle from the operational orientation to the access orientation, the pivot axis extending in a second direction nonparallel to the first direction, and the detent being movable in the second direction out of the retaining position against the bias by application of force on the receptacle tending to move the receptacle in the first direction.

* * * * *